US011635226B1

(12) United States Patent
Puga

(10) Patent No.: US 11,635,226 B1
(45) Date of Patent: Apr. 25, 2023

(54) HVAC AIR FLOW MIXING SYSTEM AND METHOD OF USE

(71) Applicant: Gustavo Puga, Murfreesboro, TN (US)

(72) Inventor: Gustavo Puga, Murfreesboro, TN (US)

( * ) Notice: Subject to any disclaimer, the term of this patent is extended or adjusted under 35 U.S.C. 154(b) by 0 days.

(21) Appl. No.: 17/825,882

(22) Filed: May 26, 2022

(51) Int. Cl.
*F24F 13/04* (2006.01)
*F24F 1/14* (2011.01)
*F24F 1/48* (2011.01)
*F24F 1/0038* (2019.01)

(52) U.S. Cl.
CPC ..... *F24F 13/04* (2013.01); *F24F 1/0038* (2019.02); *F24F 1/14* (2013.01); *F24F 1/48* (2013.01)

(58) Field of Classification Search
CPC ..... F24F 13/04
See application file for complete search history.

(56) References Cited

U.S. PATENT DOCUMENTS 9,103,573 B2 8/2015 Goenka et al.
10,369,866 B2 8/2019 Yamanaka et al.
10,391,834 B2 8/2019 Enomoto et al.
10,479,170 B2 11/2019 Enomoto et al.
2008/0028768 A1 2/2008 Goenka
2017/0030600 A1 2/2017 Blanton et al.
2019/0070924 A1 3/2019 Mancini et al.
2019/0257538 A1 8/2019 Ferrere et al.
2020/0263899 A1 8/2020 Sethuraj et al.

FOREIGN PATENT DOCUMENTS

WO WO-2019110628 A1 * 6/2019 ..... B60H 1/00849

OTHER PUBLICATIONS

WO2019110628A1 Translation (Year: 2019).*

* cited by examiner

*Primary Examiner* — Schyler S Sanks
(74) *Attorney, Agent, or Firm* — Master Key IP, LLP; Jeromye V. Sartain

(57) ABSTRACT

An HVAC air flow mixing system includes a reclaimed air loop having a duct tee configured to fluidly intersect an HVAC duct downstream of an indoor heat exchanger and a pipe in fluid communication with the duct tee and configured to fluidly communicate with the indoor unit so as to selectively reintroduce a portion of the discharged air back to the indoor unit upstream of the indoor heat exchanger.

21 Claims, 7 Drawing Sheets

HVAC AIR FLOW MIXING SYSTEM AND METHOD OF USE

BACKGROUND

The subject of this patent application relates generally to heating, ventilation, and air conditioning ("HVAC") systems, and more particularly to an HVAC air flow mixing system and method of use configured for optimally heating and cooling as by achieving increased temperature change relative to ambient.

The following description includes information that may be useful in understanding the present invention. It is not an admission that any of the information provided herein is prior art or relevant to the presently claimed invention, or that any publication specifically or implicitly referenced is prior art.

Applicant(s) hereby incorporate herein by reference any and all patents and published patent applications cited or referred to in this application, to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

By way of background, heating, ventilation, and air conditioning ("HVAC") systems are in wide use for controlling temperature in an enclosed or indoor environment relative to the ambient temperature of the surrounding outdoor environment, such indoor environments ranging from large buildings to homes to vehicles. Accordingly, in the winter months such an HVAC system operates so as to warm or heat the indoor environment relative to the colder outdoor environment, and in summer months it operates so as to cool the indoor environment relative to the hotter outdoor environment. Any such HVAC system typically then involves both an indoor and an outdoor unit, with a heat exchanger of some sort in each unit over which air passes so as to absorb heat from or transfer heat to a refrigerant, depending on the mode of operation or the season, with a series of pipes or conduits interconnecting the indoor and outdoor HVAC units, and specifically the heat exchangers, in which the refrigerant flows. A compressor and a reversing valve are typically employed in the outdoor unit for compressing the gaseous or liquid-gas refrigerant to higher pressure and thus temperature and then routing it to the indoor unit, again depending on the mode of operation, with check valves in each unit to cooperate in routing the refrigerant accordingly.

HVAC systems, or air conditioning systems and heat pumps, thus rely on the refrigerant's pressure-temperature relationship to work. When a refrigerant evaporates or boils it absorbs heat at a high rate just as with all liquified gases. Due to refrigerants such as R-12, R-22 (Freon), R-134A, R-410A (Puron), R-744, etc. having a relatively low boiling point (i.e., a very low temperature at which they are in the gaseous phase), room temperature or ambient air can provide sufficient heat for evaporation in combination with reduced pressure on the refrigerant. Even so, any given HVAC system can only exchange heat or energy with the refrigerant so efficiently, or the refrigerant can only achieve so much heat transfer or change in temperature particularly depending on the temperature of the air flow passing over the heat exchanger, and thus efficiency is often lost due to the change in temperature that is required, or the amount of heating or cooling that the HVAC system is called upon to provide, which presents a particular challenge in winter months when deep cold or sub-freezing ambient outdoor temperatures are seen.

In typical split system air source HVAC systems employed in connection with homes or other dwellings such as apartment buildings and office buildings, recirculation of interior air for further heating or cooling is common, with there being ducts and vents on the exhaust side of the indoor unit or "air handler" for pushing or delivering the conditioned air to the various parts or rooms of the building and then a return or suction side of the air handler that pulls in air from the interior environment before conditioning (heating or cooling) the air further, thus again continually recirculating and conditioning the air within the interior environment as needed according to the HVAC system parameters and settings. In that sense, exhaust air from the indoor unit is mixed back into the supply air via the return, typically up to 70-80% of the overall volume of air, but such of course happens throughout the entire home or building by design and not just immediately at the air handler, which would be self-defeating of the HVAC system and its operation. More generally, such HVAC systems are thus typically sized or balanced to achieve a certain throughput depending on the size or volume of the space to be heated or cooled, with the desired static pressure within the indoor air handler, which for a typical residential application is usually to be maintained at 0.05 to 0.1 inches of water, then dictating the size or rating of the air handler and the size of the ducting.

Alternatively and more recently, there have been proposed heat recovery or heat recuperation systems for otherwise typical HVAC systems for use in winter months wherein at the indoor unit heat energy is transferred from the exhaust air stream to the return air stream. Essentially, at least a portion of the exhaust air is passed through a separate heat exchanger or recuperator so as to deliver heat or energy to the fresh or return air supply in order to raise the temperature of the supply air at the inlet to the air handler and so improve its efficiency or require it to use relatively less power or energy through additionally heating the supply air upstream of the air handler, in the case of heat pump operation in the winter. By design, there is no air mixing or mixing of the exhaust and supply air streams in such heat recovery or recuperation systems. Rather, the exhaust and supply air streams would again only pass by each other across a heat exchanger and thus are at all times separated by the heat exchange material, with such additional heat exchanger or regenerative recuperator being in a variety of forms such as a heat pipe, plate, energy recovery wheel, and wrap-around coil.

Also known as part of typical split system air source HVAC systems are bypasses or secondary conduits or passages configured to allow a portion of the supply air to simply bypass the indoor unit heat exchanger as part of controlling the overall air flow through the air handler and thus maintaining the appropriate static pressure throughout the indoor air delivery network. In the case of such bypass lines, the arrangement and purpose is to pass supply air around the indoor unit heat exchanger or coil, or in that sense only to introduce or mix supply air into the exhaust air downstream of the air handler, not to introduce or mix exhaust air into the supply air upstream of the air handler.

In larger industrial HVAC applications or contexts where air is not simply to be recirculated within an indoor space as in the typical split system air source HVAC systems most often used in homes, buildings, and the like, the conditioned interior air is instead dumped back outside. Such nonrecirculating industrial HVAC systems are thus often employed in contexts where harmful substances such as bacteria and other organisms, flammable, poisonous, and other dangerous gases, and other such organic or inorganic airborne particles are involved, in which case such air that is conditioned (heated or cooled as needed) and introduced into the interior space is expelled from the interior space rather than recirculated within the interior space. As such, relatively warm air in the wintertime and relatively cool air in the summertime is expelled from the interior space to the exterior surroundings, of course with appropriate filtration or other treatment of such air as needed or legally required. Accordingly, "economizer" energy recovery systems have been proposed to capture and redirect at least a portion of the expelled conditioned air, such as via an energy recovery conduit in selective fluid communication between the exhaust air duct or housing outlet of an HVAC system upstream of the evaporator and an inlet of the condenser, such as shown in U.S. Patent Application Publication No. US20190257538A1 by Ferrere et al., or via an auxiliary economizer for mixing fresh environmental air and exhaust or return air and directing such mixed air to the outdoor heat exchanger, such as shown in U.S. Patent Application Publication No. US20200263899A1 by Sethuraj et al., both such references listing Johnson Controls Technology Company as the applicant.

Finally, rather than on/off cycling of a fixed-speed compressor, inverter technologies or inverter-driven compressors allow for the control or modulation of the electrical supply to the compressor of an HVAC system and thus the speed at which the compressor runs, thereby modifying the pressure of the refrigerant and hence the heat exchange capacity of the system so as to incrementally fine-tune the system and match such heat exchange capacity to demand. Accordingly, in the context of cooling, an inverter compressor operates on the discharged gaseous refrigerant so as to raise or lower the pressure, with higher pressure into the compressor producing higher output pressure and thus raising the head pressure, which allows for higher heat or energy to be stored in the refrigerant. In this way, the circulation of the refrigerant itself can be modulated for higher or lower pressure or heat exchange capacity in improving the efficiency of the HVAC system, though it will be appreciated that such does not impact the ultimate capability of the HVAC system and the particular refrigerant of achieving greater temperature change over ambient at a given compressor setting and resulting refrigerant pressure.

In the electric vehicle ("EV") context, a critical issue is thermal management, or managing the heat generated by the battery cell(s), electric motors, and other components. For the battery, there is typically a temperature range within which the battery operates optimally, such that in the summer time the battery may be in danger of overheating and so heat must be pulled away from the battery, while in the winter time, particularly at start-up, the battery may need to be supplied heat. In concert with such thermal management of the battery, there is the cabin temperature to be managed as well, which also needs to be cooled in the summer and warmed in the winter during typical usage. But to heat or cool the cabin as desired can potentially have an adverse effect on the battery both in terms of its thermal management and in terms of power draw and thus decreasing the range of the electrical vehicle, which is also a critical consideration for manufacturers and vehicle owners. As such, much effort has been invested in attempting to optimize thermal management or heat exchange or transfer in and among the various systems of the electric vehicle, all in the interest of optimizing efficiency or meeting the twin aims of passenger comfort and vehicle range, and that for all seasons and situations, not just ideal temperate climates. As such, any innovations or technological advances that aid in electric vehicle thermal management and battery optimization are highly sought after.

What is still needed and has been heretofore unavailable is the ability to efficiently and cost-effectively increase the temperature change capacity relative to ambient of a given HVAC system for building, vehicle, and other contexts. Aspects of the present invention fulfill these needs and provide further related advantages as described in the following summary.

SUMMARY

Aspects of the present invention teach certain benefits in construction and use which give rise to the exemplary advantages described below.

The present invention solves the problems described above by providing an HVAC air flow mixing system for operation in conjunction with an indoor HVAC unit having an indoor heat exchanger. In at least one embodiment, the HVAC air flow mixing system comprises a reclaimed air loop having a duct tee configured to fluidly intersect an HVAC duct downstream of the indoor heat exchanger and a pipe in fluid communication with the duct tee and configured to fluidly communicate with the indoor unit so as to selectively reintroduce a portion of the discharged air back to the indoor unit upstream of the indoor heat exchanger.

Other objects, features, and advantages of aspects of the present invention will become more apparent from the following detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Figure 1A:
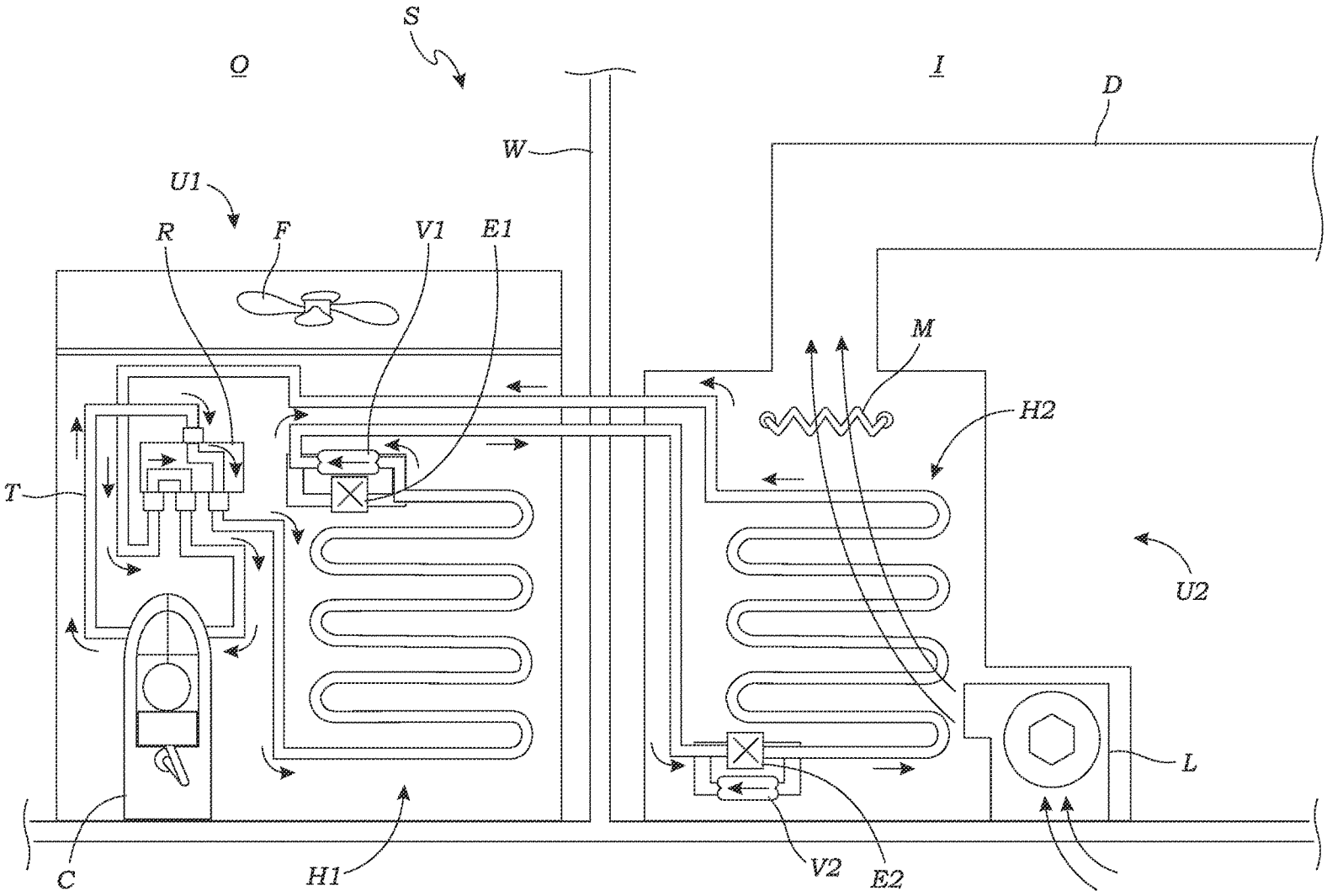
FIG. 1A PRIOR ART
FIG. 1A is a schematic view of a typical prior art split system air conditioner heat pump in a first mode of operation for cooling as in the summer.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments. More generally, those skilled in the art will appreciate that the drawings are schematic in nature and are not to be taken literally or to scale in terms of material configurations, sizes, thicknesses, and other attributes of a system according to aspects of the present invention and its components or features unless specifically set forth herein.

DETAILED DESCRIPTION

The following discussion provides many exemplary embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

While the inventive subject matter is susceptible of various modifications and alternative embodiments, certain illustrated embodiments thereof are shown in the drawings and will be described below in detail. It should be understood, however, that there is no intention to limit the invention to any specific form disclosed, but on the contrary, the inventive subject matter is to cover all modifications, alternative embodiments, and equivalents falling within the scope of the claims.

Figure 1B:
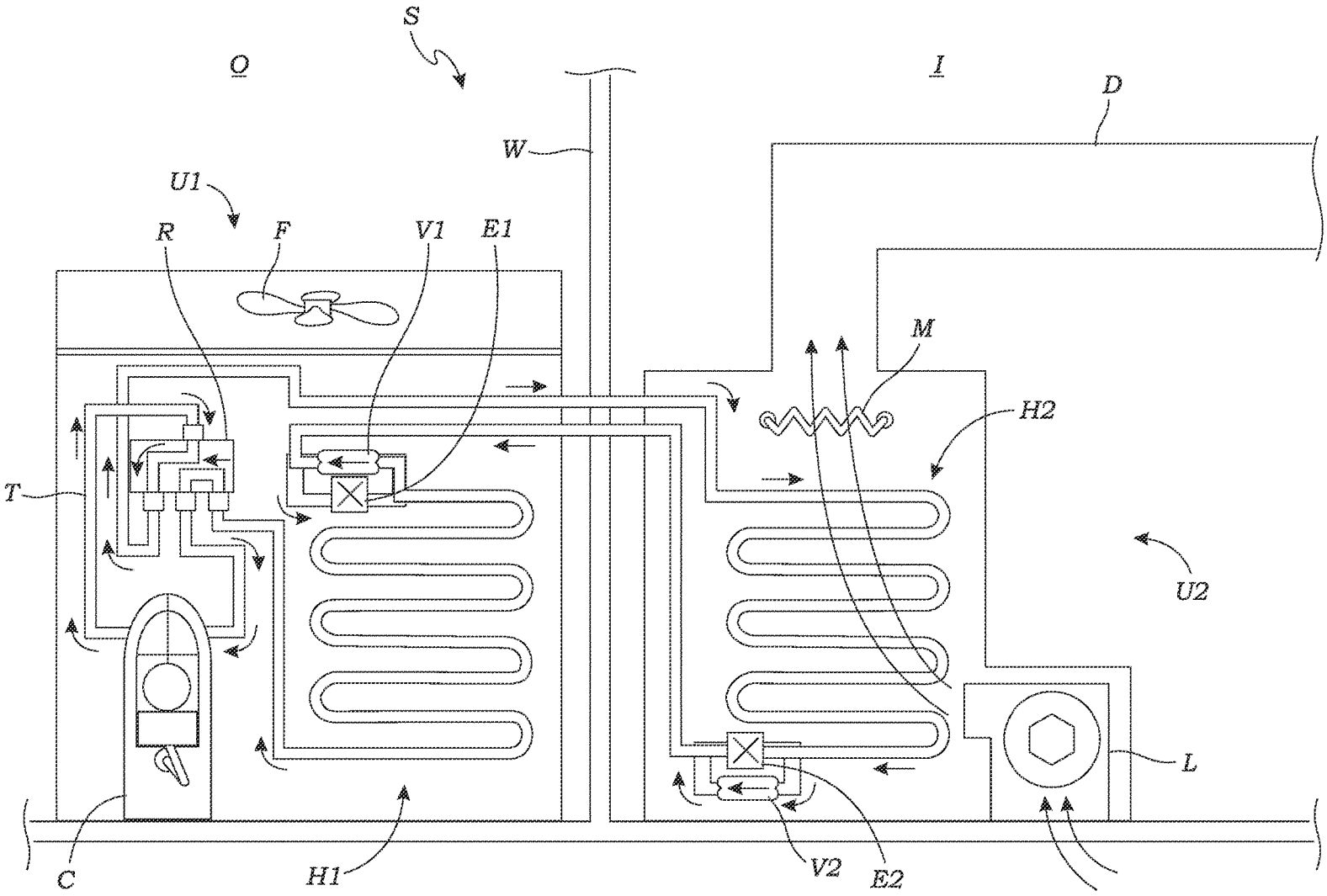
FIG. 1B PRIOR ART
FIG. 1B is a schematic view of the typical prior art split system air conditioner heat pump of FIG. 1A in a second mode of operation for heating as in the winter.

Turning initially to FIGS. 1A and 1B, there are shown schematic views of a typical prior art HVAC split system air conditioner heat pump S as generally comprising an outdoor unit U1 and an indoor unit U2, with a heat exchanger H1, H2 in each unit U1, U2 over which air passes so as to absorb heat from or transfer heat to a refrigerant (not shown), depending on the unit (outdoor or indoor) and the mode of operation or the season, with a series of pipes or conduits T interconnecting the indoor and outdoor HVAC units U1, U2 and specifically the heat exchangers H1, H2 in which the refrigerant flows. As shown, the outdoor unit U1 is located in an outdoor environment O and the indoor unit U2 is located in an indoor environment I separated from the outdoor environment O by a wall W. A compressor C and a reversing valve R are typically employed in the outdoor unit U1 for compressing the gaseous or liquid-gas refrigerant to higher pressure and thus temperature or energy and then routing the refrigerant to the indoor unit U2 either before or after the outdoor heat exchanger H1, again depending on the mode of operation, with check valves V1, V2 in each unit U1, U2 to cooperate in routing the refrigerant accordingly. Those skilled in the art will appreciate that such typical HVAC system S is represented generally and schematically herein simply for illustration and context and that the present invention is not limited to any such system S or context.

As shown in FIG. 1A, the exemplary prior art HVAC system S is illustrated in a first mode of operation for cooling as in the summer. Here, the compressor C in the outdoor unit U1 is fed cool, low pressure refrigerant vapor as exiting the indoor heat exchanger H2 and routed to the inlet of the compressor C via the reversing valve R. By way illustration, the inlet pressure of the refrigerant may be on the order of 100 psi, with the compressor C pumping the vapor into the high pressure side of the system S, such as at roughly 400 psi. The relatively hot, high pressure refrigerant gas travels from the outlet of the compressor C back through the reversing valve R and then to the outside coil or heat exchanger H1 that in the summer or cooling mode of the system S operates as the condenser. Thus, as the hot, high pressure refrigerant gas passes through the outdoor heat exchanger H1, ambient air passing thereover as caused by operation of the adjacent outdoor fan F removes heat from the refrigerant flowing in the heat exchanger H1 via convection, causing the refrigerant to condense into a liquid. The liquid refrigerant, still under relatively high pressure of on the order of 400 psi, is routed around an outdoor expansion valve E1 that is inactive in summer or cooling mode via an outdoor one-direction check valve V1 that the refrigerant is able to flow through and then on to the indoor unit U2. Specifically, on the inlet side of the indoor unit heat exchanger H2 the refrigerant is forced through an indoor expansion valve E2 via an indoor one-direction check valve V2 such that the refrigerant flow is partially restricted and thus undergoes a significant pressure drop back down to on the order of 100 psi, which allows the liquid refrigerant to begin evaporating. As the refrigerant evaporates as it travels along the indoor coil or heat exchanger H2, which thus functions as the evaporator in the summer or cooling mode, it absorbs heat from the passing air that is there forced over the indoor heat exchanger H2 by the fan or blower B of the indoor unit U2 or "air handler," thus cooling the air passing through the indoor unit U2 before the cool air then exits the unit U2 into the duct D supplying such cool air to the indoor environment I, it being appreciated that the cold evaporator H2 also collects moisture from the passing air, thereby serving as a dehumidifier for the indoor environment I as well. The relatively cool, low pressure refrigerant then passes back to the compressor C where the process is repeated.

In the winter or heating mode or alternative second mode of operation, as shown in FIG. 1B, the exemplary prior art HVAC system S effectively flips or reverses as enabled by the reversing valve R, causing the refrigerant to generally flow oppositely to that of the first operational mode or summer or cooling mode of FIG. 1A and thus the outdoor coil or heat exchanger H1 to function as the evaporator and the indoor coil or heat exchanger H2 to now function as the condenser. The compressor C in the outdoor unit U1 is again fed relatively cool, low pressure refrigerant vapor but here from the outdoor heat exchanger H1 as routed to the inlet of the compressor C via the reversing valve R, which has shifted relative to the summer or cooling mode configuration illustrated in FIG. 1A. Specifically, the relatively warm, high pressure refrigerant returning from the indoor unit U2 is forced through the outdoor expansion valve E1 via the outdoor one-direction check valve V1 such that the refrigerant flow is partially restricted and thus undergoes a significant pressure drop back down to on the order of 100 psi as it enters the outdoor coil or heat exchanger H1, which allows the refrigerant to begin evaporating. As the refrigerant evaporates as it travels along the outdoor heat exchanger H1, which again thus functions as the evaporator in the winter or heating mode, it absorbs heat from the passing air that is again forced over the outdoor heat exchanger H1 by the fan F of the outdoor unit U1, thus heating or adding energy to the refrigerant passing through the outdoor coil H1. Such relatively warm refrigerant vapor is then compressed by the compressor C, such as again from on the order of 100 psi to on the order of 400 psi on the high pressure side of the system S. Such heated and pressurized refrigerant then is routed via the conduit T again through the reversing valve R to the indoor heat exchanger H2. There, within the indoor unit U2 or "air handler," the refrigerant transfers its heat to the passing air that is again forced over the indoor heat exchanger H2 by the fan or blower B of the indoor unit U2, thus heating the air passing through the indoor unit U2 before the warm air then exits the unit U2 into the duct D while the refrigerant thus condenses to a liquid or at least partially to a liquid-gas having given up heat or energy to the indoor air, hence the indoor coil H2 functioning as the condenser in the winter or heating mode of the typical split system S illustrated in FIG. 1B. The relatively cooler though still high pressure refrigerant then exists the indoor coil H2 through the indoor one-way check valve V2, thus bypassing the indoor expansion valve E2 that is employed when the HVAC system S is in the summer or cooling mode illustrated in FIG. 1A, and returns to the outdoor coil or heat exchanger H1 via the pressure-reducing outdoor expansion valve E1, once again causing the refrigerant to then begin to evaporate and pick up heat or energy from the outdoor air, thus continuing the process for the system S in such heat pump mode.

Notably, while the exemplary prior art HVAC system S operates relatively efficiently in both cooling and heating mode, it is ultimately limited by how much the refrigerant can be pressurized and how much heat or energy exchange the refrigerant can facilitate relative to ambient conditions. For starters, a challenge is that particularly in the winter months the outdoor heat exchanger H1 functioning as the evaporator so as to absorb heat must operate at temperatures below ambient and thus often at temperatures below freezing, which very low operating temperature often causes the outdoor coil H1 to freeze over or accumulate ice or frost on the coil H1, limiting its ability to pull heat or energy from the air and into the refrigerant as described above. To address this issue, a "defrost cycle" is employed that effectively entails temporarily reversing the system S from the winter or heating mode illustrated in FIG. 1B back to the summer or cooling mode illustrated in FIG. 1A, which essentially allows heat from the indoor air stream or indoor unit U2 to be transferred to the outdoor unit U1, whereby the outdoor coil H1 again operates as the condenser so as to give off heat from the refrigerant rather than pull heat into the refrigerant. During this so-called defrost cycle, the outdoor fan F is turned off to speed up the heat exchange process and melting of the frost from the outdoor coil H1, and to prevent cool air from being dumped into the indoor environment I via the indoor coil H2 that is in such reversed defrost cycle again operating as the evaporator absorbing heat from the indoor air flow, which of course is not desirable in the winter, an auxiliary heating element M is activated to cause convective heat transfer with or into the air stream passing through the indoor unit U2 into the duct D. Beyond these frost and defrost issues for the outdoor coil or heat exchanger H1, it is also noted more generally that in such a typical split system air source HVAC system S, when operating in heating mode as a heat pump during the winter, the colder the ambient temperature or outside environment O, the smaller the change in temperature, or ΔT, of the indoor environment I relative to the outdoor environment O that the system S can cause, as indicated by the below table for context, such temperature data being based on a typical 2.5 ton HVAC system S with an AC (non-inverter) compressor. In practice, this makes it more difficult to bring the indoor environment I up to a desired temperature without supplementing the operation of the HVAC heat pump system S with auxiliary heat via the electric heating element M, in any case all of which puts more strain on the system S and ultimately consumes more energy, leading to higher costs for the owner in operating the system S particularly in the deeper colds of winter in attempting to still heat or maintain the temperature in the indoor space I as desired.

TABLE 1

Typical residential heat pump operating temperatures

| Outdoor Ambient Temperature °F. | Indoor Change in Temperature (ΔT) °F. |
|---|---|
| 65 | 32-36 |
| 60 | 30-34 |
| 55 | 28-31 |
| 50 | 26-28 |
| 45 | 23-26 |
| 40 | 21-23 |
| 35 | 19-21 |
| 30 | 18-20 |
| 25 | 17-19 |
| 20 | 16-18 |

Figure 2:
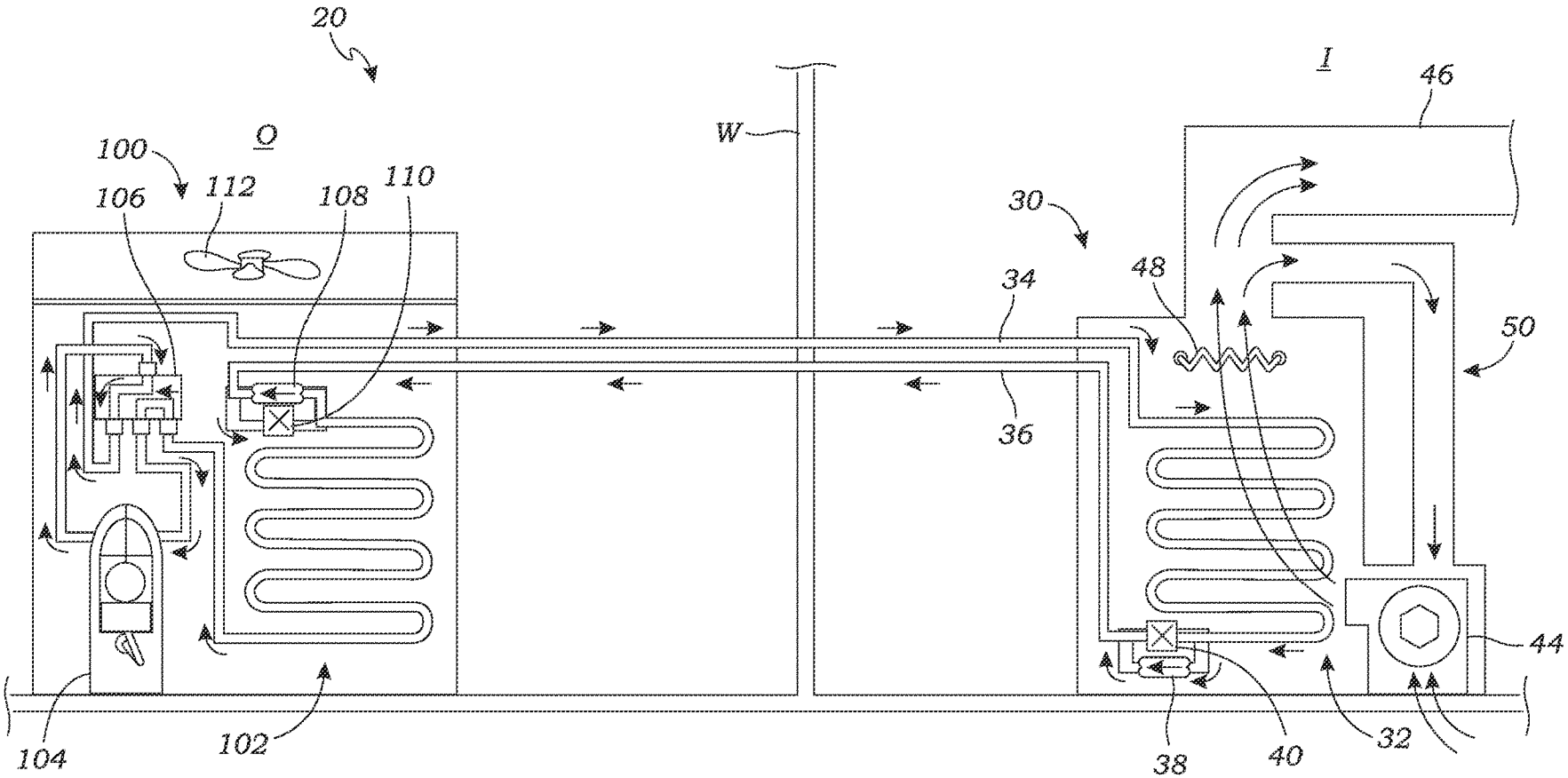
FIG. 2 is a schematic view of an exemplary HVAC system according to aspects of the present invention in the building context, in accordance with at least one embodiment.

Turning now to FIG. 2, there is shown a schematic view of an exemplary embodiment of a modified HVAC system 20 according to aspects of the present invention that for illustrative purposes is analogous to the prior art system S of FIGS. 1A and 1B. The improved system 20 comprises, in the exemplary embodiment, a reclaimed air loop 50 that is installed as part of the indoor unit 30 so as to be in fluid communication at one end with the duct 46 adjacent to the exit from the "air handler" indoor unit 30 and at the other end with or adjacent to the blower 44 that pushes supply air into the unit 30. Accordingly and at a high level, the reclaimed air loop 50 reclaims or recirculates a portion of the conditioned air leaving the indoor unit 30 as by diverting some of the air flow from the duct 46 and returning such portion of the air flow to the blower 44 for passing back into the air handler or indoor unit 30 and over the indoor coil or heat exchanger 32 for further conditioning of the air, whether heating in winter mode as illustrated in FIG. 2 or cooling in summer mode, with the indoor coil 32 being supplied refrigerant through one of a first and second recirculating conduit 34, 36. Those skilled in the art will appreciate that by capturing and redirecting a portion of the heated or cooled air after passing over the indoor heat exchanger 32 and reintroducing such air to the inlet or supply side of the indoor air handler 30 along with other air, the overall temperature of the supply air is raised (in the case of heating) or lowered (in the case of cooling), thus requiring less energy or less work by the indoor heat exchanger 32 to reach the same indoor temperature or enabling more work or higher (in the case of heating) or lower (in the case of cooling) indoor temperatures produced by the indoor heat exchanger 32 for the same energy input. As a general "rule of thumb," in heat pump mode, 1 J of energy translates to 3 J of work, and in cooling mode, 1 J of energy translates to 2 J of work. Accordingly, such a system 20 according to aspects of the present invention is capable of effectively hyper heating and hyper cooling, or in the case of deeper winters getting to hotter hots and thus increased ΔT in the indoor environment I beyond what a conventional HVAC system as shown in FIGS. 1A and 1B is able to achieve (where increased pressure is required to increase temperature change and where an increase in ΔT would typically signal too high head pressure or too low air flow). In so doing, in the case of heating, secondary auxiliary heat as by the electric heating element 48 is needed less often or only at even colder ambient temperatures in the outside environment O or during a temporary defrost cycle of the system 20 as described above. In one exemplary system 20 according to aspects of the present invention, the system 20 operates at 100% relative efficiency down to 17° F., as compared to more like 35° F. in conventional HVAC systems. To complete the basic system 20 architecture, the indoor unit 30 also comprises an indoor one-direction check valve 38 and a related indoor expansion valve 40, and the system 20 further has an outdoor unit 100 that is operably and fluidly installed in conjunction with the indoor unit 30 via the first and second refrigerant recirculating conduits 34, 36, the outdoor unit 100 comprising an outdoor coil or heat exchanger 102, a compressor 104 and reversing valve 106 in fluid communication with the heat exchanger 102, an outdoor one-direction check valve 108 that cooperates along with the reversing valve 106 and the indoor one-direction check valve 38 to direct the flow of refrigerant as appropriate depending on whether the system 20 is in winter or heating mode or summer or cooling mode, a related outdoor expansion valve 110 that operates in conjunction with the outdoor one-direction check valve 108, and a fan 112 for pulling ambient air over the heat exchanger 102. Once more, such general and schematic representations of typical components of an HVAC split system air conditioner heat pump are merely illustrative and non-limiting.

Figure 3:
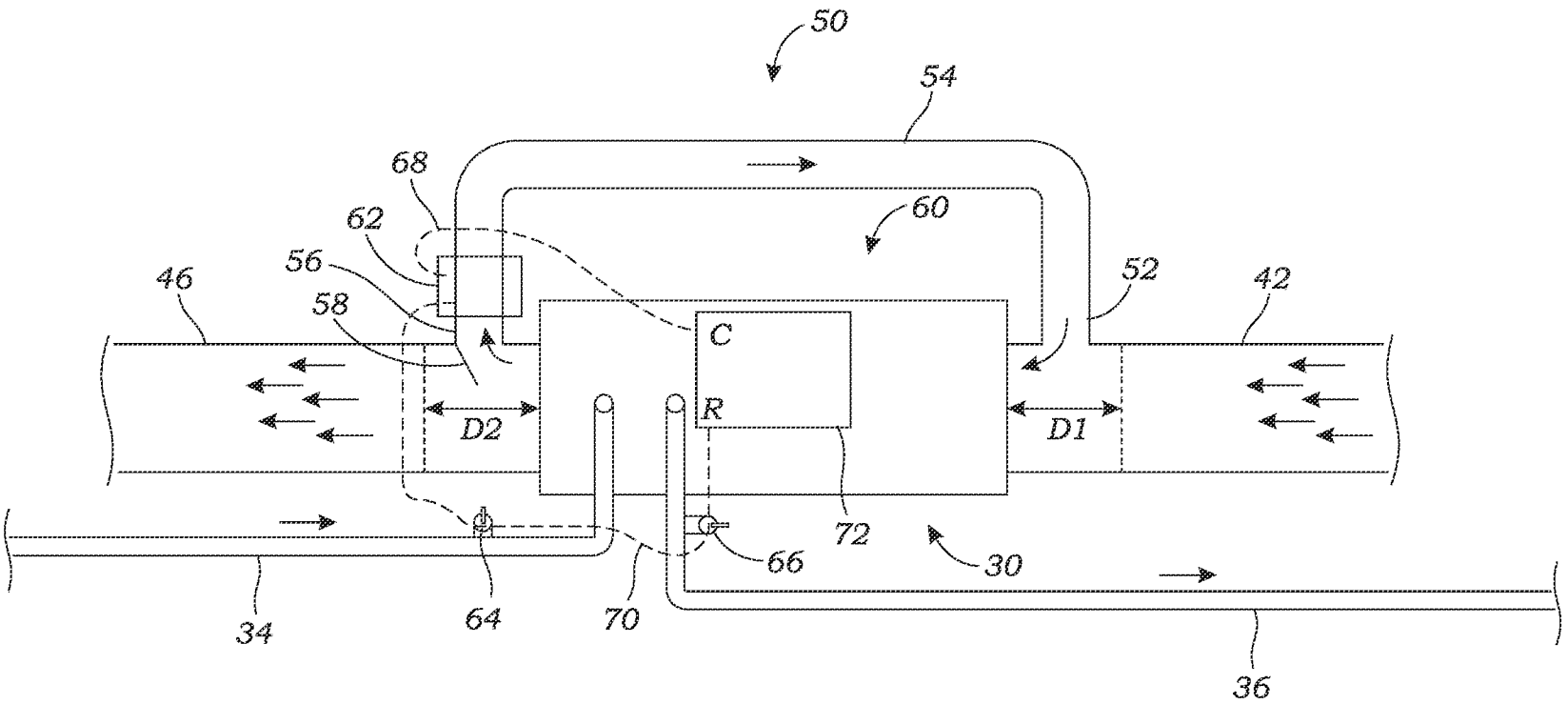
FIG. 3 is a schematic view of an indoor unit and related reclaimed air loop and control loop thereof, in accordance with at least one embodiment.

In more detail and with reference now to the further schematic view of FIG. 3, there is illustrated an exemplary reclaimed air loop 50 as installed on an indoor air handler unit 30 having an inlet return 42 for introducing supply air to the unit 30 including through return vents (not shown) and a duct 46 for delivering conditioned air to the related interior space(s) via further ducts and vents (not shown). The reclaimed air loop 50 itself comprises a return tee 52 in fluid communication with the return 42 and a duct tee 56 in fluid communication with the duct 46, the tees 52, 56 being fluidly interconnected by a pipe 54. It will be appreciated that the size or diameter or transverse dimension of the tees 52, 56 and of the pipe 54 relative to that of the return 42 and duct 46 will affect the air flow characteristics and the percent or proportion of the total air flow passing through the indoor unit 30 and particularly the exit to the duct 46 that is recirculated via the reclaimed air loop 50. In an exemplary embodiment involving a 2.5 ton air handler rated at 400 cubic feet per minute per ton or a total flow rate of 1,000 cfm, the inlet return 42 and outlet duct 46 are each nominally sixteen inches (16 in.) in diameter and the tees 52, 56 and pipe 54 are nominally eight inches (8 in.) in diameter, though it will be appreciated that a wide variety of sizes are possible to suit particular contexts, noting that in typical residential or light commercial applications the delivery and return ducts can be rectangular or square in the range of three inches by seven inches (3 in×7 in.) to thirty-five inches by forty inches (35 in.×40 in.) or can be round in the range of four inches (4 in.) to forty inches (40 in.) in diameter. Such tees 52, 56 and ducting or pipe 54 may be formed of any suitable material or construction now known or later developed, including but not limited to galvanized steel, insulated and non-insulated steel tubing, flexible metal, fiber, and flex ducting. In the case of annular tees 52, 56 and ducting or pipe 54, such may be coupled together using any appropriate means now known or later developed, including but not limited to duct tape and/or a saddle collar. Also affecting air flow through such an air handler 30 and related reclaimed air loop 50 is again of course velocity as affected in significant part by the rating and operation of the fan or blower 44 (FIG. 2). Those skilled in the art will further appreciate that air temperature, humidity, and other factors also impact air viscosity and air flow rates and characteristics as all relating to fluid dynamics principles. As is known, fluid flow is generally slower and more turbulent at the edges or boundaries of a flow conduit (boundary layer effects) or where there is a turn or disruption in the flow conduit and is faster and more laminar at the center of the flow conduit. Accordingly, an important factor in the design of an HVAC system 20 according to aspects of the present invention is to position the return tee 52 in the inlet return 42 and the duct tee 56 within the outlet duct 46 sufficiently close to the air handler 30 or more precisely the coil or heat exchanger 32 (FIG. 2). In the exemplary embodiment wherein the inlet return 42 and outlet duct 46 are each nominally sixteen inches (16 in.) in diameter and the tees 52, 56 and pipe 54 are nominally eight inches (8 in.) in diameter, the return tee 52 and the duct tee 56 are each within three feet (3 ft.) and more preferably within eighteen inches (18 in.) of the respective inlet and outlet of the air handler unit 30 as represented by distances D1 and D2, respectively, in FIG. 3, so as particularly with respect to the duct tee 56 to catch the air leaving the air handler 30 at the point of the venturi effect, or a slight pressure drop and flow acceleration, essentially right after passing over the heat exchanger 32 and leaving the air handler 30 and thereby avoid or minimize tempered air and have increased flow velocity to work with in diverting a portion of the air flow into the reclaimed air loop 50. Further in the interest of minimizing tempering of the reclaimed air, it follows that the overall length of the reclaimed air loop 50 or effectively of the pipe 54 should be as short as possible in spanning the air handler or indoor unit 30 between the outlet or downstream duct tee 56 and the inlet or upstream return tee 52; accordingly, it is preferred that the overall length of the reclaimed air loop 50 be no more than double the length or dimension of the air handler or indoor unit 30 in the air flow direction. By way of illustration and not limitation, if the overall size or length in the flow direction of the indoor unit 30 is approximately four feet (4 ft.), it would follow that the overall length of the reclaimed air loop 50 would be no more than approximately eight feet (8 ft.). In the exemplary context of a return 42 and duct 46 having a nominal diameter of sixteen inches (16 in.), it will be appreciated that the preferred distance of the respective return tee 52 and particularly the duct tee 56 proportionately is on the order of one to two diameters of the related air flow passage, or more generally the distances D1, D2 from the respective inlet and outlet sides of the air handler 30 are roughly equal to or double the passage diameter or maximum transverse dimension of the passage in the exemplary embodiment, which relationship can of course be scaled up or down as appropriate for a given system 20. Or put another way, the duct tee 56 is to be located along the duct 46 within a distance from the indoor unit 30 that is preferably no more than three times the duct maximum transverse dimension, more preferably within two times the duct maximum transverse dimension, and most preferably within one times the duct maximum transverse dimension. And sticking with the exemplary annular ducts, tees, and pipes wherein the diameter of the tees 52, 56 and pipe 54 are roughly half that of the duct 46, it follows that the cross-sectional area of the reclaimed air loop pipe 54 is on the order of twenty-five percent (25%) of the cross-sectional area of the duct 46 in roughly achieving up to approximately twenty-five percent (25%) diversion of the total air flow through the air handler 30. More generally, it is thus preferable to have the reclaimed air loop 50 as close as possible or feasible to the heat exchanger 32 or in the case of the duct tee 56 to at least tee into the duct 46 before any other branching. To further assist in diverting a portion of the air flow, a baffle 58 may be positioned adjacent to the trailing or back edge of the duct tee 56 so as to extend at some angle and distance into the duct 46 and thus the air flow so as to physically direct some of the air into the reclaimed air loop 50. The baffle 58 may be at a fixed position (length and/or angle) or may be adjustable or articulating as part of a control loop 60, more about which is said below, and where the baffle 58 is a fixed size and angle it will be appreciated that such may represent a cross-sectional area or surface area as a percentage of the overall duct 46 cross-sectional area, such as for example on the order of five to fifteen percent (5-15%). In an exemplary embodiment, up to approximately twenty-five percent (25%) of the total air flow exiting the indoor air handler unit 30 is diverted into the reclaimed air loop 50, more preferably approximately ten to twenty percent (10-20%) of the air flow, and most preferably approximately twelve to fifteen percent (12-15%) of the air flow.

With continued reference to FIG. 3, there is also shown schematically a control loop 60 as part of the indoor unit 30 of the overall HVAC system 20 that works in conjunction with the reclaimed air loop 50. A selectively operable mechanical damper 62 is installed on and within the duct tee 56 and configured to be spring-biased closed and powered open as through a motor or other driver or actuator (not shown), though it will be appreciated that any such damper configuration and related actuation means now known or later developed may be employed. Essentially, a low voltage line is connected in series between the damper 62 and a low voltage source 72, such as a 24-volt power supply, for example, with a first electrical wire or leg 68 connected in series from one side or terminal of the damper 62 to one side or terminal of the low voltage source 72 (e.g., "C") and a second electrical wire or leg 70 connected in series from the other or second side or terminal of the damper 62 through a first temperature sensor/switch 64 installed on the first refrigerant conduit 34 in fluid communication with one end of the indoor coil or heat exchanger 32 (FIG. 2) and a second temperature sensor/switch 66 installed on the second refrigerant conduit 36 in fluid communication with the opposite end of the indoor coil or heat exchanger 32 and then on to the second side or terminal of the low voltage source 72 (e.g., "R"). It will thus be appreciated that so long as the low voltage source 72 is powered on and neither temperature sensor/switch 64, 66 trips, meaning that the temperatures detected are within a prescribed range, the damper will also be powered and remain open, whether fully or partially, while if either temperature sensor/switch 64, 66 trips as by reading a temperature outside of a prescribed range, power will be cut to the damper 62 and it will close under the influence of the incorporated mechanical biasing spring, thus effectively shutting off the reclaimed air loop 50 until the required temperature in the first and/or second conduit 34, 36 is again seen as monitored by the respective first and second temperature sensor/switch 64, 66. In the exemplary embodiment, each temperature sensor/switch 64, 66 is advantageously mounted to the outside surface of the respective first and second conduit 34, 36 and so is non-invasive, which those skilled in the art will appreciate will not in any way compromise the refrigerant conduits 34, 36 or present any new risk of a refrigerant leak developing, recalling that the refrigerant lines 34, 36 can see pressures of 400 psi or more. Further, it will be appreciated that by monitoring temperature, the system 20 is not only non-invasive but is also not refrigerant dependent, meaning that different refrigerants may be employed and operate at different pressures but the desired temperature ranges for the indoor coil 32 as measured on the suction and liquid lines 34, 36 depending on whether in heating or cooling mode as explained further below are in that sense absolute. Moreover, as will be appreciated, the present system 20 does not even rely on increasing refrigerant pressure beyond what the system 20 is nominally set up for, but instead gains efficiency based on the use of reclaimed air as explained herein, without relying on or requiring any change to the high or low pressure side of the system 20. The first and second temperature sensors/switches 64, 66 can and typically will have different specifications or parameters, each being on a different refrigerant line 34, 36 that would be under different pressure and thus have flowing therethrough refrigerant at a different operating temperature. In a further exemplary embodiment, the control loop 60 may also operate based on temperature readings from one or both of the first and second temperature sensors/switches 64, 66 to incrementally adjust the position of the damper 62 and/or the baffle 58 so as to incrementally adjust the size of the opening into the duct tee 56 and/or the reach into the air flow within the duct 46 and thus the amount of air being diverted from the duct 46 into the reclaimed air loop 50 rather than an "all or nothing" configuration. It will be appreciated that such incremental mechanical adjustment of the reclaimed air flow from the outlet of the indoor air handler 30 based on data points such as temperature readings on the refrigerant lines 34, 36 into or out of the indoor coil 32 allows for intelligent and automated system operation via the control loop 60, with the idea behind any such temperature-based feedback loop being not only to provide for a non-invasive implementation that is not pressure or refrigerant dependent or at all compromising of or adversely affecting the pressurized refrigerant lines 34, 36 but also a way of protecting or providing a fail-safe for the overall system 20 as by preventing overheating or freezing of particularly the indoor coil 32, more about which is said below regarding the system 20 in operation.

In use and referring still to FIGS. 2 and 3, in winter when the HVAC system 20 is operating in heating mode and the indoor coil or heat exchanger 32 is functioning as the condenser with the suction line or first conduit 34 being the inlet to the indoor coil 32 and with the liquid line or second conduit 36 being the exit from the indoor coil or heat exchanger 32, in an exemplary embodiment the second temperature sensor/switch 66 on the liquid line 36 is rated at 130° F.+/−20° F. and so will "open" above 150° F. and no longer supply current to the damper 62, causing the damper 62 and thus the reclaimed air loop 50 to close, preventing the HVAC system 20 from overheating, with the second temperature sensor/switch 66 closing at 110° F. and thereby again powering the damper 62 to open it and thus turn the reclaimed air loop 50 back on, though it will be appreciated that a variety of temperature sensors/switches now known or later developed and at various temperature ranges or temperature trip values may be employed according to aspects of the present invention; however, it is generally advantageous to have a relatively small temperature range in some instances so that the reclaimed air loop 50 may open and close relatively more frequently, particularly when approaching the freezing point for water of 32° F. at sea level. Accordingly, there is shown and described a reclaimed air loop 50 and related control loop 60 that enables selective diversion of a portion of the air flow from the duct 46 just after leaving the indoor unit or air handler 30 back into the air handler 30 at the return 42 or otherwise, which conditioned air or heated air in this example thus raises the overall or average temperature of the supply or return air then entering the air handler 30, thus rendering the related indoor coil or heat exchanger 32 more thermally effective or efficient or enabling still greater heat transfer or "hotter hots," thereby improving the overall efficiency of the HVAC system 20 and, again in the exemplary context of the winter and the system 20 operating in heating mode, enabling the system 20 to produce greater proportional temperature increase or ΔT in the indoor environment I for a given ambient temperature in the outdoor environment O than a comparable system S without such a reclaimed air loop 50 (FIG. 1B) and that without increasing head pressure or reducing flow rate, more about which is said below. By way of further illustration and not limitation, when operating in heating mode as a heat pump during the winter, while it is still true that the colder the ambient temperature or outside environment O, the smaller the change in temperature, or ΔT, of the indoor environment I relative to the outdoor environment O that the system 20 can cause, such an HVAC system 20 according to aspects of the present invention effectively shifts things such that the change in temperature for the indoor environment I at a given ambient temperature of the outdoor environment O is proportionately greater—for example, in the inventive system 20, the change in indoor temperature (ΔT) at approximately 20° F. outside temperature that may be achieved is now more analogous to what the typical split system air source HVAC system S is capable of at approximately 45° F. outside temperature, the change in indoor temperature (ΔT) at approximately 25° F. outside temperature that may be achieved is now more analogous to what the typical split system air source HVAC system S is capable of at approximately 50° F. outside temperature, etc. Those skilled in the art will thus appreciate that such an HVAC system 20 according to aspects of the present invention as employing a reclaimed air loop 50 is capable of relatively greater change in indoor temperature (ΔT) for a given outdoor ambient temperature and as a result can reach typical desired indoor temperatures of roughly 65-70° F. in the winter without any auxiliary heat or operation of the electric heating element 48 even when outdoor temperatures are around freezing or are roughly 30-35° F. and even when outdoor temperatures are sub-freezing, auxiliary heat or operation of the electric heating element 48 will be called upon less frequently, thereby saving the owner utility costs while maintaining the desired comfortable indoor temperature in the winter. It is also noted that a relatively high ΔT does not have to mean low air flow (again, high ΔT is better, in controlled state with air flow). Even so and more generally, it will be appreciated that the foregoing is merely illustrative of aspects and benefits of an HVAC system 20 according to aspects of the present invention and such temperature effects and any associated air flow or velocity can vary depending on a number of factors including but not limited to the air handler 30 capacity or rating, including its blower 44, the size and length of ducts 46 and number of vents (not shown), whether there is a ducted or piped return 42, and the total volume of the interior space I that is to be heated or cooled.

Briefly, continuing with an HVAC system 20 according to aspects of the present invention in use, now in cooling mode as in the summer, which for the indoor unit 30 relative to FIG. 3 only involves a reversal of the flow of refrigerant in the first and second lines 34, 36 feeding the indoor coil or heat exchanger 32 (FIG. 2) as will be appreciated from the above discussion related to FIGS. 1A and 1B, the indoor coil 32 now functions as the evaporator with the liquid line or second conduit 36 being the inlet to the indoor coil 32 and the suction line or first conduit 34 being the exit from the indoor coil or heat exchanger 32. The first temperature sensor/switch 64 installed on the first conduit 34 is in the exemplary embodiment rated at 35-40° F. and will "open" below 35° F. and no longer supply current to the damper 62, causing the damper 62 and thus the reclaimed air loop 50 to close, preventing the indoor coil 32 of the indoor unit 30 of the HVAC system 20 from freezing, with the first temperature sensor/switch 64 closing at 40° F. and thereby powering the damper 62 to open it and thus turn the reclaimed air loop 50 back on. Again, other temperature sensors/switches now known or later developed configured to operate at various temperature ranges or temperature trip values may be employed, though once more, it is generally advantageous to have a relatively small temperature range, particularly when approaching the freezing point for water of 32° F. as here so as to effectively maximize the operation of the reclaimed air loop 50. It will also be appreciated by those skilled in the art that in the summer or cooling mode, the recycled or reclaimed air reintroduced to the inlet or return 42 of the air handler 30 also further helps with humidity reduction as more and more heat is absorbed from the passing air stream, which additional humidity reduction (e.g., below 55% humidity) causes the exhaust air entering the duct 46 to feel relatively cooler, such that the system 20 can operate relatively warmer or at a higher temperature setting on the thermostat in the summer for example and still feel cooler or cool enough, yielding further cost savings in operation of an HVAC system 20 according to aspects of the present invention.

Once more, the pair of in-line temperature sensors/switches 64, 66 as part of the control loop 60 thus serve as "fail safes" for the HVAC system 20 during both heating and cooling modes so as to keep the system 20 operating within acceptable parameters even as it operates more optimally due to selective employment of the reclaimed air loop 50. It will be appreciated that in winter mode, the suction line or first conduit 34 that is on the inlet side of the indoor coil 32 will remain well above 35° F., in which case the suction side temperature sensor/switch 64 will always remain closed and thus supply power to the damper 62, while the second temperature sensor/switch 66 on the liquid line or second conduit 36 that is on the outlet side of the coil or heat exchanger 32 in the winter mode of operation of the HVAC system 20 thus operates as the "fail safe" for the winter or heat pump mode to prevent the HVAC system 20 or particularly the indoor coil 32 from overheating or carrying too much heat and reaching excessive pressure even after heat is extracted from the refrigerant flowing in the indoor coil 32 as air passes over it. Whereas in summer mode, the liquid line or second conduit 36 that here is on the inlet side of the indoor coil 32 will never get anywhere close to 150° F., in which case the second temperature sensor/switch 66 will always remain closed and thus supply power to the damper 62, instead now the temperature sensor/switch 64 on the suction line or first conduit 34 that is here on the outlet side of the coil or heat exchanger 32 in the summer mode of operation of the HVAC system 20 thus operates as the "fail safe" for the summer or cooling mode to prevent the HVAC system 20 or particularly the indoor coil 32 from freezing or maintaining temperatures that are too low even as heat is absorbed by the refrigerant in the indoor coil 32 as air passes over it.

Figure 4:
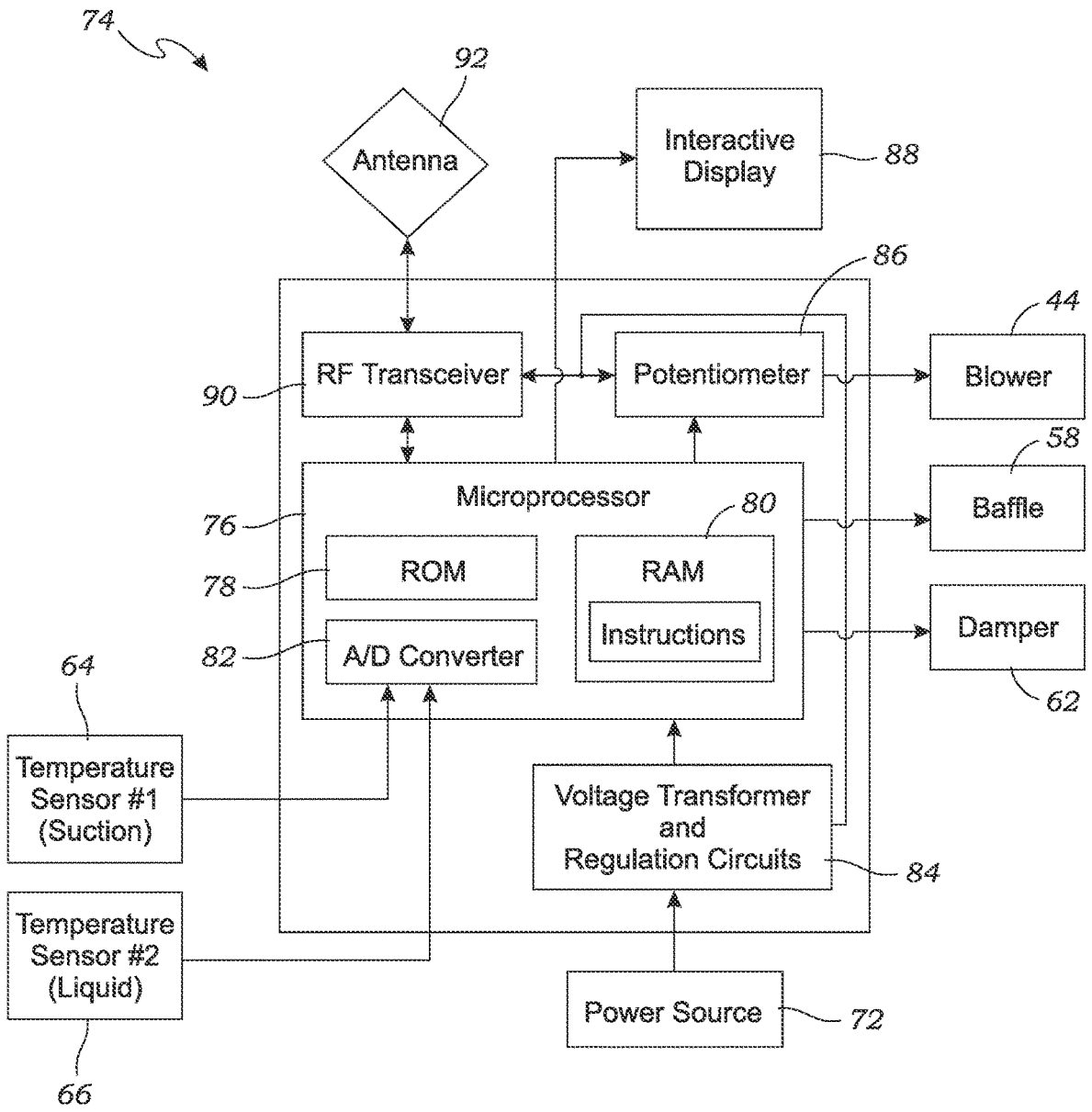
FIG. 4 is a block diagram of an exemplary control module as might be employed in conjunction with an exemplary HVAC system according to aspects of the present invention, in accordance with at least one embodiment.

By way of further illustration and not limitation, with the exemplary damper 100% open, such reclaimed air loop 50 may again achieve the desired 10-20% or more air flow diversion from the outlet side of the air handler 30 back to the inlet or return side of the air handler 30, with a basic principle being that there will be a particular flow rate or "cfm" at a particular static pressure or "psi." Once more, such a flow diversion from the outlet duct 46 via the reclaimed air loop 50 results in effectively no loss of air flow or static pressure, with the air just reintroduced to the return 42 or inlet side of the air handler 30 but still maintained within the overall indoor system (e.g., the static pressure may be on the order of 0.08 to 0.1 inches of water at the air handler 30 compared to as low as 0.05 inches of water in the ducts 46 particularly further downstream of the air handler 30). Advantageously, the "bypass factor," or the percentage of air that doesn't actually touch the coil or engage in heat exchange, is effectively reduced by an HVAC system 20 and particularly an air handler 30 according to aspects of the present invention through the reintroduction of a portion of such air via the reclaimed air loop 50, thereby effectively increasing or improving the "evaporator approach" for a given system 20. Again, it is also possible to instead regulate or modulate the damper 62 between 0% (fully closed) and 100% (fully open) to achieve a desired reclaimed air loop 50 flow diversion and overall flow rate (cfm) through the air handler 30, with further optimization based on damper 62 operation as well as fan or blower 44 speed in conjunction with the temperature sensors/switches 64, 66 for both increased efficiency and system integrity as herein described. It will be appreciated that in one exemplary embodiment where both the damper 62 and the blower 44 are controlled as part of the control loop 60, the fan 44 speed is essentially proportional to the damper 62 position (i.e., a larger opening, higher fan speed; smaller opening, lower fan speed, except at cold start when fan speed may be inversely proportional to damper position), and such adjustments can be made while maintaining the overall air handler 30 throughput or air flow rate or by not reducing the static pressure or causing an appreciable pressure drop that might adversely affect flow rate and thus heating or cooling by the system 20. Staying with the exemplary 10-20% overall air flow diversion via the reclaimed air loop 50, or at or below 15%, for example, the overall air flow (cfm) of the HVAC system indoor unit or air handler 30 is not compromised, and using a variable speed motor for the air handler fan or blower 44 would allow even more than 15% air flow diversion. Accordingly, by way of illustration and not limitation and with reference now to the block diagram of FIG. 4, operation of such alternative automated system 20 may be facilitated by a control loop 60 having a control module 74 that is operably connected to a power supply such as the low voltage source 72, to any temperature sensors such as the first and second temperature sensor/switches 64, 66 as well as any flow rate or other sensors (not shown) positioned within the air handler unit 30, the return 42 and/or the duct 46, and to both the damper 62 and/or any baffle 58 as by selectively controlling a motor or actuator (not shown) to position such mechanical components as desired and the fan or blower 44 as by selectively controlling fan speed and thus flow rate in the main air handler passage. In the exemplary embodiment, such control module 74 includes a controller or processor or microcontroller or microprocessor 76 having a read only memory or ROM 78, a random access memory or RAM 80 containing instructions, for example, and an analog-to-digital or A/D converter 82 configured to supply the processor 76 with digital temperature data or signals from the first and second temperature sensor/switches 64, 66. A voltage regulator or potentiometer 86 may be provided within the control module 74 for purposes of controlling or modulating the fan speed or operation of the blower 44 under the direction of the microprocessor 76, and a voltage transformer and/or regulation circuits 84 may be provided to ensure proper power is provided to the microprocessor 76 and other electronic components of the control module 74 from the power source 72, which again may be a 24-volt power supply but also 12-volt as in a vehicle context, 40-volt, or any other such power supply now known or later developed. For purposes of communicating or interacting with the HVAC system 20 and the related control loop 60, the control module 74 may also be equipped with an interactive display 88 such as a touchscreen and/or an RF transceiver 90 and related antenna 92. It will be appreciated by those skilled in the art that any such intelligent HVAC air flow mixing system 20 and the control loop 60 thereof may include related circuitry having a processor with embedded code, a power source, one or more sensors, one or more voltage regulators, potentiometers, or the like, a transceiver for wireless communication to other circuit components and/or a remote control unit such as a thermostat or a smartphone app that may interface with and obtain data from and provide data to the system 20 and particularly the control loop 60, and various other circuit components and thus that any appropriate control loop 60 and related circuit configuration and elements, whether now known or later developed, may be employed in an HVAC system 20 according to aspects of the present invention without departing from its spirit and scope.

Figure 5:
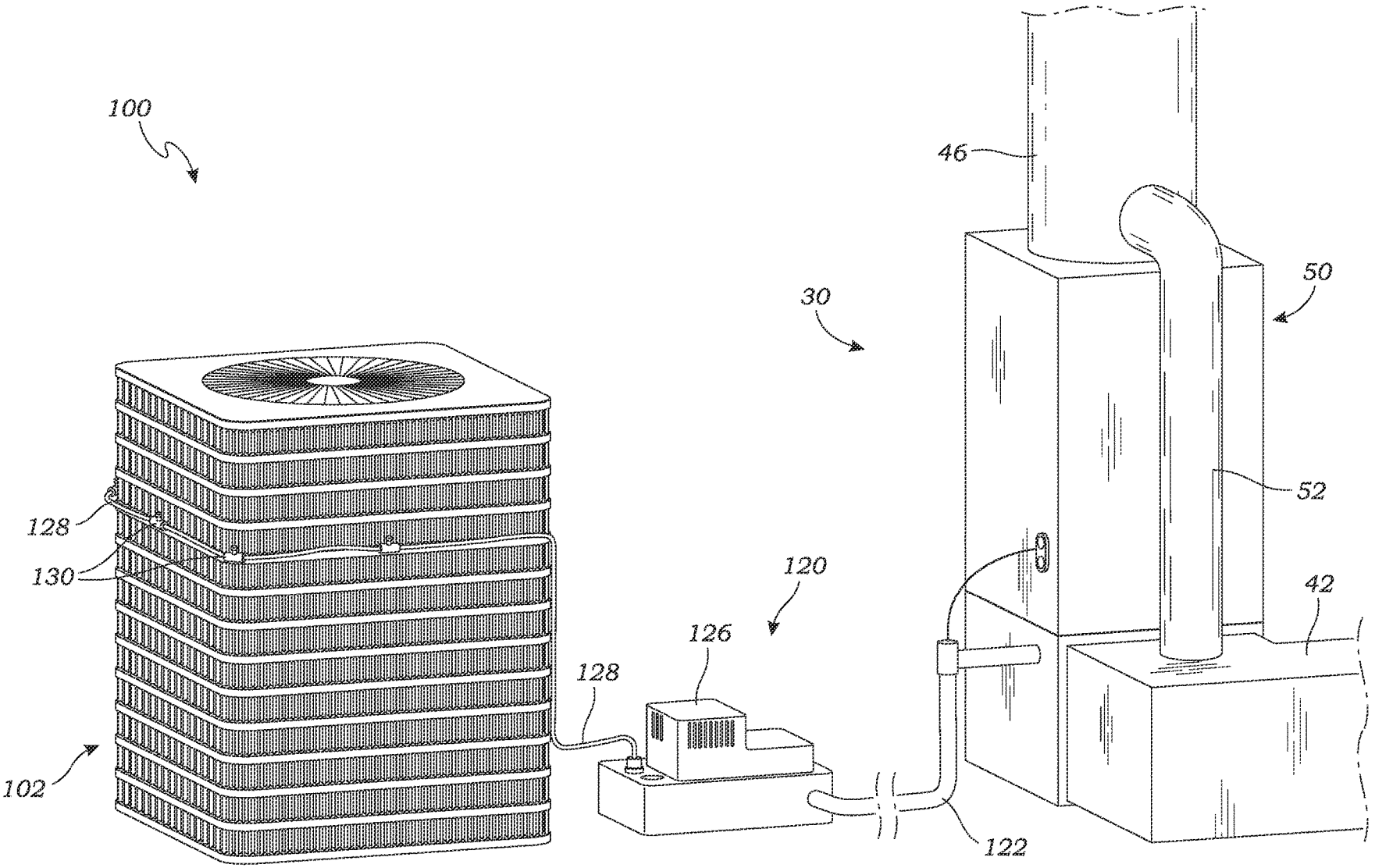
FIG. 5 is a perspective view of an exemplary HVAC system according to aspects of the present invention, in accordance with at least one embodiment.

In terms of installation and commercial applicability, first in connection with split system air source HVAC systems employed in connection with buildings of various kinds and so with reference to FIG. 5 along with FIGS. 2 and 3, those skilled in the art will appreciate that an HVAC system 20 according to aspects of the present invention may easily be installed after-market or as a retrofit of an existing indoor air handler 30 as by operably installing an appropriately sized reclaimed air loop 50 by teeing into the exhaust duct 46 immediately downstream of the air handler 30 and the cabinet of the blower 44 or the return 42 or otherwise immediately upstream of the air handler 30 as well as installing the related control loop 60 components, which are either part of the reclaimed air loop 50 and related duct tee 56 such as the damper 62 and any baffle 58 or in the case of the two exemplary temperature sensors/switches 64, 66 are simply "bolt-ons" for the respective refrigerant lines 34, 36, with the low voltage source 72 either already existing with the air handler 30 or also after-market. And any and all such components of the system 20 as installed in conjunction with the indoor unit or air handler 30 would still fit within a typical air handler closet or attic space where such air handler 30 is positioned. Moreover, such HVAC system 20 and particularly the reclaimed air loop 50 and related control loop 60 may also be implemented in a new installation or as part of original equipment even contained "within the box." Additionally, according to a further aspect of the present invention and as also shown in FIG. 5, such an HVAC system 20 may further comprise a condensation recovery system 120 to further improve its efficiency. Condensation collected from the indoor coil or heat exchanger 32 when the system 20 is operating in the summer or cooling mode such that the indoor coil 32 functions as the evaporator is routed through a condensation pipe 122 to a small condensation pump 126 that then supplies such condensation to the outdoor unit 100 via a condensation line 128. It will be appreciated that where the indoor unit 30 is at a higher elevation than the outdoor unit 100 the pump 126 may not even be needed, instead gravity feed of the condensation may be sufficient. Relatedly, such recovered condensation may be sprayed onto the outdoor coil 102 as by nozzles 130 along the condensation line 128 or may trickle or cascade down the coil 102 again simply by gravity. Those skilled in the art will appreciate that regardless, the application of such condensation to the outdoor coil 102 that in the summer or cooling mode functions as the condenser will facilitate more rapid and efficient heat exchange or specifically dumping heat from the condenser coil 102 and thereby cooling the refrigerant flowing therethrough. In other words, such condensation applied to the coil 102 improves its latent heat transfer process essentially for free, particularly in the gravity feed context. And by applying the condensation from the "top down" via gravity or even spraying or misting the condensation onto preferably the top portion or third of the coil is most advantageous, where the refrigerant is hottest and heat exchange is the greatest. And it will be further appreciated that such condensation as essentially moisture from the air is relatively pure and thus less corrosive to the coil 102 than chemically treated tap water. Accordingly, a further exemplary feature of an HVAC system 20 according to aspects of the present invention is to recover and utilize condensation from the evaporator on the condenser coil, on which basis it will be appreciated that such can be accomplished in a variety of ways employing a variety of hardware beyond that shown and described without departing from the spirt and scope of the invention.

It will also be appreciated by those skilled in the art that such a system 20 can be easily scaled up or down to suit a particular residential or commercial HVAC application. Moreover, an HVAC system 20 according to aspects of the present invention can be scaled down and implemented in connection with vehicle heating and cooling systems operating on the same heat exchange principle. That is, generally a vehicle HVAC or "heat pump" system also involves an "outdoor" unit that in the traditional internal combustion engine context is essentially the radiator or condenser that is fed relatively high pressure refrigerant from a compressor that gives off heat to passing air and a fluidly connected A/C evaporator that receives relatively low pressure refrigerant via an expansion valve and thus absorbs heat from the passing air flow as the refrigerant evaporates so as to cool the air stream that is then routed into the passenger compartment of the vehicle via ducts and vents. However, rather than involving a split system with reversing valve as in building HVAC applications as described herein, the standard vehicle HVAC system typically involves a separate heat exchanger or heater core that is itself a condenser that obtains hot antifreeze from the vehicle's cooling system as the engine warms up and thus heats air passing over the heater core, the A/C evaporator and/or the heater core individually or collectively defining the "indoor" or cabin unit of the vehicle's HVAC system. A related mechanical temperature blend door also downstream of the A/C evaporator or between the evaporator and the heater core enables selective mixing or blending of the cold air leaving the evaporator coil and the hot air leaving the heater core, at one extreme in full cooling or "A/C" mode with the compressor operating and the blend door fully blocking the heater core, all air passes from the evaporator into the cabin, and at the other extreme in full heating mode the door may be shifted to force all air from the evaporator across the heater core or may bypass the evaporator altogether. Therefore, employing a reclaimed air loop according to aspects of the present invention as teeing in immediately after and before the evaporator and/or the heater core and thus routing or diverting a portion of the cooled or heated air, as the case may be, back to the inlet of the respective evaporator or heater core will thus enable such components to achieve more efficient or effective heat exchange or reach "hotter hots" or "colder colds" for the same energy or work input. Any such automotive HVAC system with reclaimed air loop and any related control loop in principle as set forth herein may thus be configured whether "from the factory" or via an aftermarket retrofit to enable relatively greater temperature change ($\Delta T$) for the exhaust air or cabin air relative to ambient, it being appreciated by those skilled in the art that in any such context an improved system according to aspects of the present invention may involve components and particularly the reclaimed air loop that are sized accordingly or proportionally to the context and specifically to the heat exchange elements of whatever kind and related air flow conduits supplying air to and routing air away from such heat exchangers.

Figure 6:
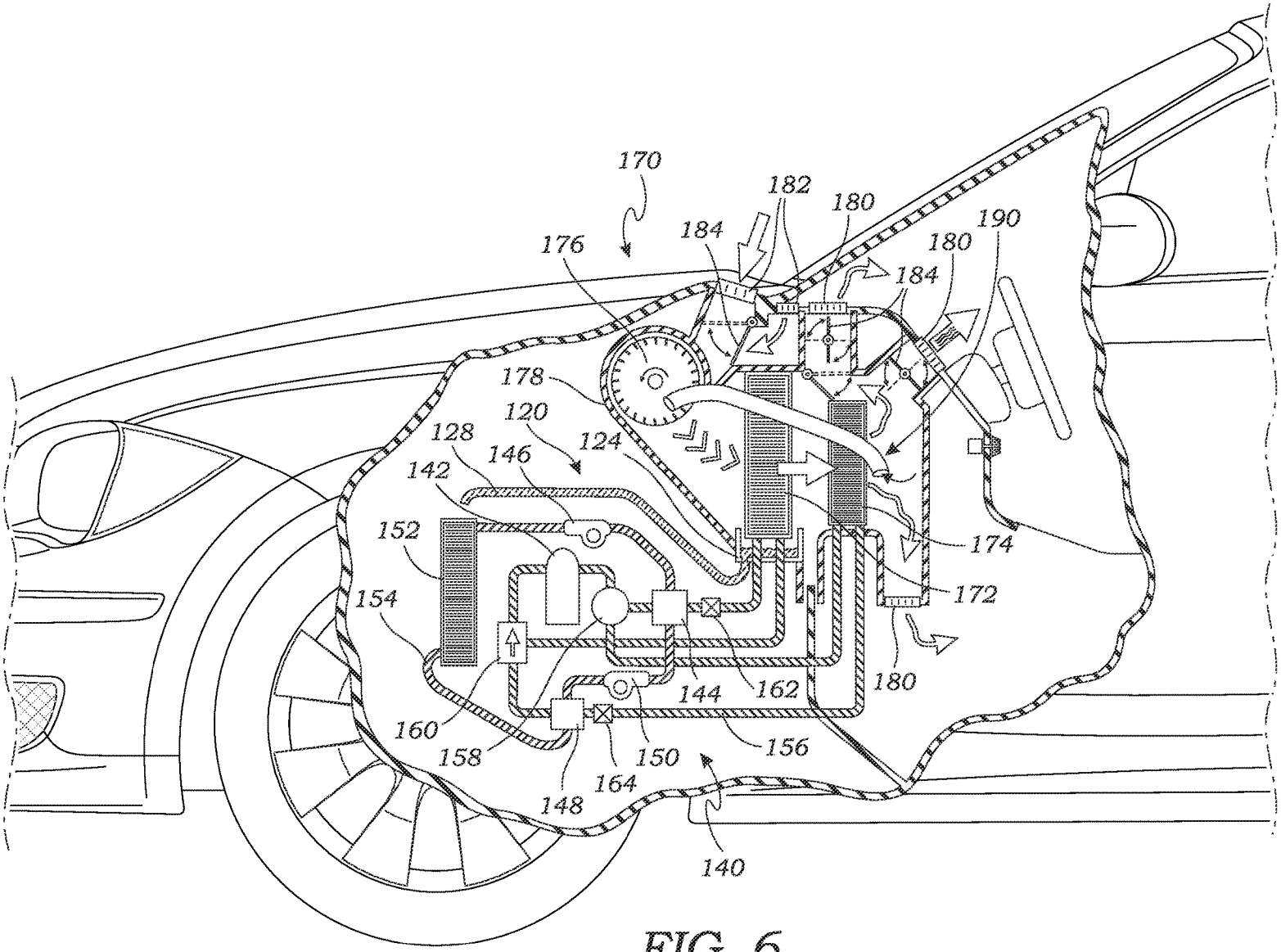
FIG. 6 is a side schematic view of a further exemplary HVAC system according to aspects of the present invention in the automotive context, in accordance with at least one embodiment.

Notably, and by way of further illustration with reference to FIG. 6, in the case of electric vehicles where there is no internal combustion engine to draw heat off of via refrigerant (antifreeze), operating any such HVAC system in heating mode is more analogous to the herein described traditional heat pump and/or an electric resistance heater or element, the latter again being less efficient and effective and consuming significant power. An electric vehicle heating system is even more taxed in cold weather, where such system is needed to heat not just the cabin but even the battery, all of which can affect the vehicle's range and overall performance. Such an application would thus benefit from a "tighter" reclaimed air loop around a heater core or even an electric heating element to reduce the proportional amount of work or power draw from the battery required to get the electric vehicle cabin to a desired temperature. In the case of the more efficient heat pump arrangement that some electric vehicles are moving toward, as shown in FIG. 6, it will be appreciated that the heat pump 140 generally comprises a compressor 142, a condenser 144, and an evaporator or chiller 148 with a refrigerant line 156 fluidly communicating between such external heat exchangers and components and the internal or cabin evaporator 172 and condenser 174 that along with a fan 176 generally comprise the interior or "indoor" cabin unit 170, the cabin evaporator 172 and cabin condenser 174 together defining the "indoor heat exchanger" in the automotive heat pump 140 context. In a bit more detail, in the automotive heat pump 140, refrigerant circulates in one direction and once leaving the compressor 142 it is directed via a three-way valve 158 either to the external condenser 144 when in cooling mode or directly to the cabin condenser 174 when in heating mode. That is, in cooling or "A/C" mode of the EV heat pump 140, the compressed and heated refrigerant is routed via the three-way valve 158 to the condenser 144 where the refrigerant gives off heat or is cooled before flowing through an expansion valve 162 and then on to the cabin evaporator 172 where air passing over the evaporator 172 is cooled as heat from the air is pulled into the refrigerant, such refrigerant then exiting the cabin evaporator 172 and returning to the compressor 142 via a one-way valve 160. Likewise, in heating mode, the compressed and heated refrigerant is routed via the three-way valve 158 again directly to the cabin condenser 174 where air passing over the condenser 174 picks up heat from the refrigerant, which refrigerant is then routed from the cabin condenser 174 through an expansion valve 164 to the exterior evaporator or chiller 148 to pick up heat as the refrigerant again evaporates before passing through the one-way valve 160 back to the compressor 142. Accordingly, rather than having a reversing valve and one exterior and one interior heat exchanger each of which serving as the condenser or evaporator depending on the season and the HVAC mode of operation and thus flow of refrigerant as in the typical building HVAC split system air conditioner heat pump, the automotive heat pump 140 effectively involves four heat exchangers, namely, an external condenser 144 and evaporator 148 and an internal condenser 174 and evaporator 172. Internally or within the cabin unit 170, the evaporator 172, condenser 174, and fan 176 are contained within a case 178 equipped with outlet vents 180, inlet returns 182 for both fresh air and recycled cabin air, and operable doors 184 for controlling air flow throughout the case 178 and overall cabin unit 170, the case 178 effectively defining or forming both the exhaust duct and the return or the air flow volume or channel for the "indoor heat exchanger" made up of the cabin evaporator 172 and condenser 174 in the automotive heat pump 140 context. Notably, according to aspects of the present invention, a reclaimed air loop 190 is configured at, on, or in the cabin unit 170 so as to tee into the case 178 just downstream of the cabin condenser 174 and then just upstream of the cabin evaporator 172 at or near the fan 176 so as to divert a portion of the conditioned air effectively from the outlet of the cabin heat exchangers back to their inlet, which it will again be appreciated renders the overall heat exchange process more efficient and the system capable of "hotter hots" or "colder colds" for the same energy or work input or relatively greater temperature change ($\Delta T$) for given ambient conditions and system operation. Once more, the size of the reclaimed air loop 190 relative to the case 178 or air flow channel of the cabin unit 170 may vary depending on a number of factors, but may facilitate diversion of up to approximately twenty-five percent (25%) of the total air flow exiting the cabin heat exchangers 172, 174 and again may include a damper or baffle or the like and related control system for optimal operation, including as in the illustrated building HVAC system 20 shown and described herein temperature sensors/switches for monitoring the refrigerant temperatures such as leaving the cabin evaporator 172 in cooling or "A/C" mode and leaving the cabin condenser 174 in heating mode. These and other applications of an improved HVAC system according to aspects of the present invention are possible and may take numerous forms or configurations without departing from its spirit and scope.

With continued reference to FIG. 6, it will also be appreciated that such exemplary automotive or EV heat pump 140 is shown as having an optional secondary coolant heat exchange system as well. That is, rather than the exterior heat exchangers, namely, the condenser 144 and evaporator 148, exchanging heat with the air, ambient or otherwise, they exchange heat with a coolant that is circulated separately from the refrigerant system of the heat pump 140 as described above. Particularly, the condenser 144 is configured as a liquid cooled condenser or "LCC" that not only is fluidly connected within the heat pump refrigerant system and related refrigerant line 156 as having an internal coil through which refrigerant flows but also is separately fluidly connected to a coolant system and related coolant line 154. Similarly, the external evaporator 148 is configured as a chiller that again is not only fluidly connected within the heat pump refrigerant system and related refrigerant line 156 but also the coolant system and line 154. Accordingly, it will be appreciated that in operation of the automotive heat pump 140, in cooling or "A/C" mode the refrigerant pulls heat from the air via the cabin evaporator 172 and dumps that heat into the coolant within the liquid cooled condenser 144. And in heating mode the refrigerant picks up heat from the coolant in the chiller 148 and dumps that heat into the air via the cabin condenser 174. Likewise, the coolant circulating within the coolant line 154 picks up heat from the refrigerant in the liquid cooled condenser 144 and dumps that heat either into the air via a further condenser in the form of a radiator 152 for dissipation of such latent heat from the coolant and/or into the refrigerant via the chiller 148. A shown, an LLC pump 146 downstream of the liquid cooled condenser 144 and a chiller pump 150 downstream of the chiller 148 serve to circulate the coolant. As an aside, in order to regulate cabin temperature in such an automotive heat pump 140 arrangement, the compressor 142 is preferably inverter driven for "fine tuning" the heat transfer via the refrigerant. Much more sophistication can then be added to such a system in addressing overall thermal management objectives, such as further selectively routing such coolant to the EV battery (not shown) in order to heat or cool the battery depending on ambient conditions and thus heat pump mode and/or to the motors and other electronics (not shown) for cooling or heat removal as needed. Notably, as also shown in FIG. 6, in the cooling or "A/C" mode of the automotive heat pump 140, any condensation forming on the cabin evaporator 172 may be collected in a trap 124 and routed via a condensation line 128 to the radiator 52 to facilitate improved heat exchange. Depending on the elevation of the radiator 52 relative to the cabin evaporator 172, such condensation flow may simply be gravity based or a small pump (not shown) may be employed in the condensation line 128 as needed. Regardless, such condensation may thus be captured and put to use and thermal advantage rather than wasted on the ground as currently. And in a more conventional heat pump arrangement wherein there is no secondary coolant system and thus an air-based heat exchange condenser is employed rather than a liquid cooled condenser, such recovered condensation may be instead directed to the condenser rather than a radiator, which would not be needed, in either case the condenser and/or radiator and the chiller individually or collectively defining the "outdoor" heat exchanger. Either way, such recovered condensation again aids in improving heat exchange efficiency, and whether a condenser in a traditional heat pump setup or a secondary radiator in a liquid cooled heat pump setup is employed, in the exemplary embodiment such condensation may simply be dripped or cascaded over such heat exchanger from the top down, though it may be sprayed or misted as well. Those skilled in the art will again appreciate that a variety of other configurations of such an HVAC automotive heat pump system 140 and related cabin unit 170 are possible, whether now known or later developed, and that the present invention is not limited thereto, but again involves reclaimed air such as facilitated by the reclaimed air loop 190 and/or recovered condensation as facilitated by the condensation recovery system 120 according to aspects of the present invention, such that the exemplary embodiments are to be understood as illustrative and non-limiting.

Aspects of the present specification may also be described as follows:

1. An HVAC air flow mixing system for operation in conjunction with an indoor unit having an indoor heat exchanger fluidly connected to a first conduit and oppositely to a second conduit with a refrigerant selectively flowing therethrough, the indoor unit discharging air that has passed over the indoor heat exchanger into a duct, the indoor unit having a length in the air flow direction, the system comprising: a reclaimed air loop having a duct tee configured to fluidly intersect the duct downstream of the indoor heat exchanger, the reclaimed air loop further having a pipe in fluid communication with the duct tee and configured to fluidly communicate with the indoor unit so as to selectively reintroduce a portion of the discharged air back to the indoor unit upstream of the indoor heat exchanger; wherein the duct has a duct maximum transverse dimension defined adjacent to the indoor unit and further wherein the duct tee is configured to be located along the duct within a distance from the indoor unit that is no more than three times the duct maximum transverse dimension; wherein the reclaimed air loop is no longer than double the length of the indoor unit; and wherein in use up to approximately twenty-five percent (25%) of the discharged air is diverted and reintroduced to the indoor unit via the reclaimed air loop, whereby in use of the system the indoor unit operates more efficiently.

2. The system of embodiment 1 wherein the pipe has a pipe maximum transverse dimension that is up to one half of the duct maximum transverse dimension.

3. The system of embodiment 1 or embodiment 2 wherein the duct has a duct cross-sectional area, and the pipe has a pipe cross-sectional area that is up to twenty-five percent (25%) of the duct cross-sectional area.

4. The system of any of embodiments 1-3 wherein in use ten to twenty percent (10-20%) of the discharged air is diverted and reintroduced to the indoor unit.

5. The system of any of embodiments 1-4 wherein in use twelve to fifteen percent (12-15%) of the discharged air is diverted and reintroduced to the indoor unit.

6. The system of any of embodiments 1-5 wherein the reclaimed air loop further comprises a return tee configured to fluidly intersect a return of the indoor unit, the pipe configured to fluidly communicate between the duct tee and the return tee and thus between the duct downstream of the indoor unit and the return upstream of the indoor unit.

7. The system of any of embodiments 1-6 further comprising a control loop having a selectively operable damper configured to be installed at the duct tee and to be biased closed and powered open, the control loop further having at least one temperature sensor/switch configured to be installed on one of the first and second conduits for measuring the temperature of the refrigerant therein, the temperature sensor/switch being electrically connected in series between the damper and a power source for selectively powering and opening the damper and thus the duct tee and the pipe for selective diversion and reintroduction of a portion of the discharged air back to the indoor unit.

8. The system of embodiment 7 wherein the control loop further comprises a control module having a microprocessor with an A/D converter through which analog temperature data from the at least one temperature sensor/switch is communicated.

9. The system of embodiment 7 or embodiment 8 wherein the control loop further comprises a control module having a microprocessor configured to be in electrical communication with the damper for selectively controlling the damper position incrementally between fully open and fully closed.

10. The system of embodiment 8 or embodiment 9 wherein the microprocessor is configured to be in electrical communication with a blower of the indoor unit positioned upstream of the indoor heat exchanger for selectively pushing air across the indoor heat exchanger.

11. The system of any of embodiments 7-10 wherein the control loop further comprises a control module having a microprocessor in electrical communication with an RF transceiver and antenna for selective wireless communication with the control module.

12. The system of any of embodiments 7-11 wherein the control loop further comprises a control module having a microprocessor in electrical communication with an interactive display for selective interaction with the control module.

13. The system of any of embodiments 1-12 further comprising a baffle configured to be positioned adjacent to the duct tee so as to extend into the duct and help direct a portion of the discharged air into the reclaimed air loop.

14. The system of any of embodiments 1-13 further comprising a condensation recovery system configured for collecting condensation from the indoor heat exchanger functioning as an evaporator and selectively directing the condensation onto an outdoor heat exchanger functioning as a condenser.

15. The system of embodiment 14 wherein the condensation recovery system comprises a condensation trap configured to be positioned beneath the indoor heat exchanger for gravitational collection of condensation and further comprises a condensation line in fluid communication with the condensation trap and having an opposite outlet configured to be positioned adjacent to the outdoor heat exchanger.

16. The system of any of embodiments 1-15 wherein: the indoor unit defines an automotive cabin unit and the indoor heat exchanger comprises a cabin evaporator and an offset cabin condenser, the cabin evaporator, the cabin condenser, and a fan upstream thereof being housed within a case defining the duct; and the reclaimed air loop is configured to be in fluid communication with the case downstream of at least one of the cabin evaporator and the cabin condenser for in use selectively diverting and reintroducing a portion of the discharged air back to the case adjacent to the fan upstream of at least one of the cabin evaporator and the cabin condenser.

17. The system of embodiment 16 wherein the reclaimed air loop is configured to span both the cabin evaporator and the cabin condenser, wherein in use the reclaimed air loop diverts a portion of the discharged air downstream of the cabin condenser and reintroduces the portion of discharged air upstream of the cabin evaporator.

18. The system of embodiment 16 or embodiment 17 wherein a condensation trap is configured to be located beneath the cabin evaporator for collecting condensation and further wherein in use a condensation line from the condensation trap selectively delivers condensation to an outdoor heat exchanger functioning as a condenser.

19. A method of employing an HVAC air flow mixing system as defined in any one of embodiments 1-18, the method comprising the steps of: installing the reclaimed air loop as by the duct tee fluidly intersecting the duct downstream of the indoor heat exchanger and the pipe fluidly communicating with the duct tee and the indoor unit; and operating the indoor unit so as to selectively reintroduce a portion of the air discharged from the indoor unit back to the indoor unit upstream of the indoor heat exchanger via the reclaimed air loop.

20. The method of embodiment 19, wherein the step of installing the reclaimed air loop further comprises the return tee fluidly intersecting the return of the indoor unit upstream of the indoor heat exchanger and fluidly connecting the pipe between the duct tee and the return tee and thus between the duct downstream of the indoor unit and the return upstream of the indoor unit.

21. The method of embodiment 19 or embodiment 20, wherein the step of installing the reclaimed air loop further comprises positioning the duct tee along the duct within a distance from the indoor unit that is no more than three times the duct maximum transverse dimension.

22. The method of any of embodiments 19-21, wherein the step of installing the reclaimed air loop further comprises sizing the reclaimed air loop to be no longer than double the length of the indoor unit.

23. The method of any of embodiments 19-22, further comprising the step of sizing the duct tee and the pipe such that approximately twenty-five percent (25%) of the discharged air is diverted and reintroduced to the indoor unit via the reclaimed air loop.

24. The method of any of embodiments 19-23, wherein the pipe is sized having a pipe maximum transverse dimension that is up to one half of the duct maximum transverse dimension.

25. The method of any of embodiments 19-24, further comprising the step of installing the control loop as by installing the selectively operable damper at the duct tee and electrically connecting the damper in series to the at least one temperature sensor/switch installed on one of the first and second conduits and to the power source for selectively powering and opening the damper and thus the duct tee and the pipe for selective diversion and reintroduction of a portion of the discharged air back to the indoor unit based on temperature readings by the at least one temperature sensor/switch.

26. The method of any of embodiments 19-25, further comprising the step of installing the condensation recovery system as by installing the condensation trap beneath the indoor heat exchanger functioning as an evaporator and installing the condensation line in fluid communication with the condensation trap for selectively directing the condensation from the condensation trap onto the outdoor heat exchanger functioning as a condenser.

27. The method of any of embodiments 19-26, further comprising operating the control module of the control loop remotely.

28. The method of any of embodiments 19-27, further comprising operating the control module of the control loop via the interactive display.

29. A kit comprising an HVAC air flow mixing system as defined in any one of embodiments 1-18.

30. The kit of embodiment 29, further comprising instructional material.

31. The kit of embodiment 30, wherein the instructional material provides instructions on how to perform the method as defined in any one of embodiments 19-28.

32. Use of an HVAC air flow mixing system as defined in any one of embodiments 1-18 to increase the temperature change capacity relative to ambient of a given HVAC system.

33. The use of embodiment 32, wherein the use comprises a method as defined in any one of embodiments 19-28.

In closing, regarding the exemplary embodiments of the present invention as shown and described herein, it will be appreciated that an HVAC system is disclosed and configured for efficiently and cost-effectively increasing the temperature change capacity relative to ambient of a given HVAC system. Because the principles of the invention may be practiced in a number of configurations beyond those shown and described, it is to be understood that the invention is not in any way limited by the exemplary embodiments, but is generally able to take numerous forms without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

In some embodiments, the numbers expressing quantities of components or ingredients, properties such as dimensions, weight, concentration, reaction conditions, and so forth, used to describe and claim certain embodiments of the inventive subject matter are to be understood as being modified in some instances by terms such as "about," "approximately," or "roughly." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the inventive subject matter are approximations, the numerical values set forth in any specific examples are reported as precisely as practicable. The numerical values presented in some embodiments of the inventive subject matter may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. The recitation of numerical ranges of values herein is merely intended to serve as a shorthand method of referring individually to each separate value falling within the range. Unless otherwise indicated herein, each individual value of a numerical range is incorporated into the specification as if it were individually recited herein. Similarly, all lists of values should be considered as inclusive of intermediate values unless the context indicates the contrary.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc. —for identified elements are used to distinguish between the elements, and do not indicate or imply a required or limited number of such elements, and do not indicate a particular position or order of such elements unless otherwise specifically stated.

All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the inventive subject matter and does not pose a limitation on the scope of the inventive subject matter otherwise claimed. No language in the application should be construed as indicating any non-claimed element essential to the practice of the invention.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C and N, the text should be interpreted as requiring only one element from the group, not A plus N, or B plus N, etc.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. An HVAC air flow mixing system for operation in conjunction with an indoor unit having an indoor heat exchanger fluidly connected to a first conduit and oppositely to a second conduit with a refrigerant selectively flowing therethrough, the indoor unit discharging air that has passed over the indoor heat exchanger into a duct, the indoor unit having a length in the air flow direction, the system comprising:

a reclaimed air loop having a duct tee configured to fluidly intersect the duct downstream of the indoor heat exchanger, the reclaimed air loop further having a pipe in fluid communication with the duct tee and configured to fluidly communicate with the indoor unit so as to selectively reintroduce a portion of the discharged air back to the indoor unit upstream of the indoor heat exchanger;

wherein the duct has a duct maximum transverse dimension defined adjacent to the indoor unit and further wherein the duct tee is configured to be located along the duct within a distance from the indoor unit that is no more than three times the duct maximum transverse dimension;

wherein the reclaimed air loop is no longer than double the length of the indoor unit; and wherein in use up to approximately twenty-five percent (25%) of the discharged air is diverted and reintroduced to the indoor unit via the reclaimed air loop.

2. The system of claim 1 wherein the pipe has a pipe maximum transverse dimension that is up to one half of the duct maximum transverse dimension.

3. The system of claim 1 wherein the duct has a duct cross-sectional area, and the pipe has a pipe cross-sectional area that is up to twenty-five percent (25%) of the duct cross-sectional area.

4. The system of claim 1 wherein in use ten to twenty percent (10-20%) of the discharged air is diverted and reintroduced to the indoor unit.

5. The system of claim 4 wherein in use twelve to fifteen percent (12-15%) of the discharged air is diverted and reintroduced to the indoor unit.

6. The system of claim 1 wherein the reclaimed air loop further comprises a return tee configured to fluidly intersect a return of the indoor unit, the pipe configured to fluidly communicate between the duct tee and the return tee and thus between the duct downstream of the indoor unit and the return upstream of the indoor unit.

7. The system of claim 1 further comprising a control loop having a selectively operable damper configured to be installed at the duct tee and to be biased closed and powered open, the control loop further having at least one temperature sensor and/or switch configured to be installed on one of the first and second conduits for measuring the temperature of the refrigerant therein, the temperature sensor and/or switch being electrically connected in series between the damper and a power source for selectively powering and opening the damper and thus the duct tee and the pipe for selective diversion and reintroduction of a portion of the discharged air back to the indoor unit.

8. The system of claim 7 wherein the control loop further comprises a control module having a microprocessor with an analog-to-digital converter through which analog temperature data from the at least one temperature sensor and/or switch is communicated.

9. The system of claim 7 wherein the control loop further comprises a control module having a microprocessor configured to be in electrical communication with the damper for selectively controlling the damper position incrementally between fully open and fully closed.

10. The system of claim 9 wherein the microprocessor is configured to be in electrical communication with a blower of the indoor unit positioned upstream of the indoor heat exchanger for selectively pushing air across the indoor heat exchanger.

11. The system of claim 7 wherein the control loop further comprises a control module having a microprocessor in electrical communication with an RF transceiver and antenna for selective wireless communication with the control module.

12. The system of claim 7 wherein the control loop further comprises a control module having a microprocessor in electrical communication with an interactive display for selective interaction with the control module.

13. The system of claim 1 further comprising a baffle configured to be positioned adjacent to the duct tee so as to extend into the duct and help direct a portion of the discharged air into the reclaimed air loop.

14. The system of claim 1 further comprising a condensation recovery system configured for collecting condensation from the indoor heat exchanger functioning as an evaporator and selectively directing the condensation onto an outdoor heat exchanger functioning as a condenser.

15. The system of claim 14 wherein the condensation recovery system comprises a condensation trap configured to be positioned beneath the indoor heat exchanger for gravitational collection of condensation and further comprises a condensation line in fluid communication with the condensation trap and having an opposite outlet configured to be positioned adjacent to the outdoor heat exchanger.

16. The system of claim 1 wherein:

the indoor unit defines an automotive cabin unit and the indoor heat exchanger comprises a cabin evaporator and an offset cabin condenser, the cabin evaporator, the cabin condenser, and a fan upstream thereof being housed within a case defining the duct; and the reclaimed air loop is configured to be in fluid communication with the case downstream of at least one of the cabin evaporator and the cabin condenser for in use selectively diverting and reintroducing a portion of the discharged air back to the case adjacent to the fan upstream of at least one of the cabin evaporator and the cabin condenser.

17. The system of claim 16 wherein the reclaimed air loop is configured to span both the cabin evaporator and the cabin condenser, wherein in use the reclaimed air loop diverts a portion of the discharged air downstream of the cabin condenser and reintroduces the portion of discharged air upstream of the cabin evaporator.

18. The system of claim 16 wherein a condensation trap is configured to be located beneath the cabin evaporator for collecting condensation and further wherein in use a condensation line from the condensation trap selectively delivers condensation to an outdoor heat exchanger functioning as a condenser.

19. An HVAC system comprising:

an indoor unit having an indoor heat exchanger fluidly connected to a first conduit and oppositely to a second conduit with a refrigerant selectively flowing therethrough, the indoor unit discharging air that has passed over the indoor heat exchanger into a duct, the indoor unit having a length in the air flow direction;

an outdoor unit having an outdoor heat exchanger fluidly connected to the first and second conduits; and a reclaimed air loop having a duct tee fluidly intersecting the duct downstream of the indoor heat exchanger and a pipe in fluid communication with the duct tee and fluidly communicating with the indoor unit so as to selectively reintroduce a portion of the discharged air back to the indoor unit upstream of the indoor heat exchanger;

wherein the duct has a duct maximum transverse dimension defined adjacent to the indoor unit and further wherein the duct tee is located along the duct within a distance from the indoor unit that is no more than three times the duct maximum transverse dimension;

wherein the reclaimed air loop is no longer than double the length of the indoor unit; and wherein in use up to approximately twenty-five percent (25%) of the discharged air is diverted and reintroduced to the indoor unit via the reclaimed air loop.

20. An HVAC air flow mixing system for operation in conjunction with an indoor unit having an indoor heat exchanger fluidly connected to a first conduit and oppositely to a second conduit with a refrigerant selectively flowing therethrough, the indoor unit discharging air that has passed over the indoor heat exchanger into a duct, the indoor unit having a length in the air flow direction, the system comprising:

a reclaimed air loop having a duct tee configured to fluidly intersect the duct downstream of the indoor heat exchanger, the reclaimed air loop further having a pipe in fluid communication with the duct tee and configured to fluidly communicate with the indoor unit so as to selectively reintroduce a portion of the discharged air back to the indoor unit upstream of the indoor heat exchanger;

wherein the reclaimed air loop is no longer than double the length of the indoor unit; and wherein in use up to approximately twenty-five percent (25%) of the discharged air is diverted and reintroduced to the indoor unit via the reclaimed air loop.

21. An HVAC air flow mixing system for operation in conjunction with an indoor unit having an indoor heat exchanger fluidly connected to a first conduit and oppositely to a second conduit with a refrigerant selectively flowing therethrough, the indoor unit discharging air that has passed over the indoor heat exchanger into a duct, the indoor unit having a length in the air flow direction, the system comprising:

a reclaimed air loop having a duct tee configured to fluidly intersect the duct downstream of the indoor heat exchanger, the reclaimed air loop further having a pipe in fluid communication with the duct tee and configured to fluidly communicate with the indoor unit so as to selectively reintroduce a portion of the discharged air back to the indoor unit upstream of the indoor heat exchanger;

wherein the duct has a duct cross-sectional area, and the pipe has a pipe cross-sectional area that is up to twenty-five percent (25%) of the duct cross-sectional area;

wherein the duct tee is configured to be located along the duct prior to any other branching; and wherein in use up to approximately twenty-five percent (25%) of the discharged air is diverted and reintroduced to the indoor unit via the reclaimed air loop.

* * * * *